US007698848B1

(12) United States Patent
Bentley

(10) Patent No.: US 7,698,848 B1
(45) Date of Patent: Apr. 20, 2010

(54) FOLDING GUNSTOCK

(75) Inventor: James K. Bentley, Paso Robles, CA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 397 days.

(21) Appl. No.: 11/704,023

(22) Filed: Feb. 8, 2007

Related U.S. Application Data

(60) Provisional application No. 60/771,754, filed on Feb. 8, 2006.

(51) Int. Cl.
*F41C 23/14* (2006.01)

(52) U.S. Cl. ..... 42/73

(58) Field of Classification Search ..... 42/71.01–74
See application file for complete search history.

(56) References Cited

U.S. PATENT DOCUMENTS

| | | | | | |
|---|---|---|---|---|---|
| 1,016,695 | A * | 2/1912 | Kimmel | 42/72 |
| 1,096,861 | A * | 5/1914 | Redfield | 42/72 |
| 1,184,078 | A * | 5/1916 | Cooke | 42/118 |
| 1,315,215 | A * | 9/1919 | Davidson | 42/72 |
| 1,477,445 | A * | 12/1923 | Petritsch | 42/72 |
| 2,400,349 | A * | 5/1946 | Haberstump | 42/72 |
| 2,424,194 | A * | 7/1947 | Sampson et al. | 42/72 |
| 2,466,017 | A * | 4/1949 | Farber | 42/72 |
| 3,201,887 | A * | 8/1965 | Sedelow | 42/72 |
| 3,256,632 | A * | 6/1966 | Beretta | 42/72 |
| 3,269,380 | A * | 8/1966 | Stevens | 124/25 |
| 3,570,162 | A * | 3/1971 | Suddarth | 42/72 |
| 3,648,396 | A * | 3/1972 | Smith | 42/94 |
| 3,782,019 | A * | 1/1974 | Venturini | 42/72 |
| 4,291,482 | A * | 9/1981 | Bresan | 42/72 |
| 4,766,800 | A * | 8/1988 | Miller et al. | 89/33.02 |
| 4,788,785 | A * | 12/1988 | White | 42/72 |
| 5,272,956 | A * | 12/1993 | Hudson | 89/128 |
| 5,410,833 | A * | 5/1995 | Paterson | 42/73 |
| 6,560,911 | B2 * | 5/2003 | Sharp | 42/73 |
| 6,564,492 | B2 * | 5/2003 | Weldle et al. | 42/74 |

* cited by examiner

*Primary Examiner*—Troy Chambers
(74) *Attorney, Agent, or Firm*—Bowman Green Hampton & Kelly, PLLC

(57) ABSTRACT

A folding stock assembly for firearms such as rifles and shotguns. The stock is made of metal rod that has been bent to form laterally spaced left and right elongated arm members that have rear ends connected to the top end of a U-shaped shoulder rest portion. The front end of the respective elongated arm members are pivotally connected to the rear end of a neck portion extending rearwardly from the upper end of the handgrip. There is structure in the interior of the end cap for locking the elongated arm members in either its static storage position or its rearward functional deployed position.

9 Claims, 4 Drawing Sheets

FOLDING GUNSTOCK

This application claims the priority of U.S. Provisional Patent Application 60/771,754 filed Feb. 8, 2006.

BACKGROUND OF THE INVENTION

The invention relates to firearms such as rifles and shotguns. More specifically the invention relates to a folding stock assembly that would be mounted on the rearwardly extending neck portion adjacent the top end of a handgrip.

It is an object of the invention to provide a folding stock assembly having novel structure for limiting both forward and rearward rotation.

It is another object of the invention to provide a folding stock assembly having novel structure for locking it in its static forward stored position and also locking it in its rearward functional deployed position.

It is also an object of the invention to provide a folding stock assembly having a novel structure for securing it to a rearwardly extending neck portion formed adjacent the top end of a handgrip.

It is an additional object of the invention to provide a folding stock assembly that is economical to manufacture and market.

It is a further object of the invention to provide a folding stock assembly that is easily installed.

SUMMARY OF THE INVENTION

The primary components of the folding stock assembly are the elongated stock, the structure for controlling rotation of the stock from a stored position to a deployed position, and structure for securing the stock to the rear end of the neck portion of a handgrip. The elongated stock is preferably made of metal rod that is bent to form laterally spaced elongated left and right arm members each having a front end and a rear end. The metal rod is also bent to form a U-shaped shoulder rest portion whose top ends are connected to the rear ends of the respective elongated arm members. There is sufficient springiness to the metal rod that allows the front ends of the elongated arm members to be squeezed together for a purpose to be discussed later. The elongated stock could also be made of a proper plastic material.

There are front end members connected to the front ends of the respective elongated arm members. Extending inwardly from the respective front end members is a left shaft and a right shaft. A left disc is secured to the left shaft and the right disc is secured to the right shaft. There are diametrically opposed secondary apertures formed in the rear end of the tubular portion at the rear end of the neck portion of the handgrip. There are diametrically opposed primary apertures in the end cap that telescopes over the tubular rear end of the neck portion. The left and right shafts are inserted into the respective primary and secondary apertures prior to the left and right discs being installed on the inner ends of the respective shafts. The respective discs are tightened onto the shafts by set screws that can be reached by an Allen wrench inserted through the open front end of tubular member on the rear end of the neck portion of the handgrip.

DESCRIPTION OF THE PREFERRED EMBODIMENT

Figure 1:
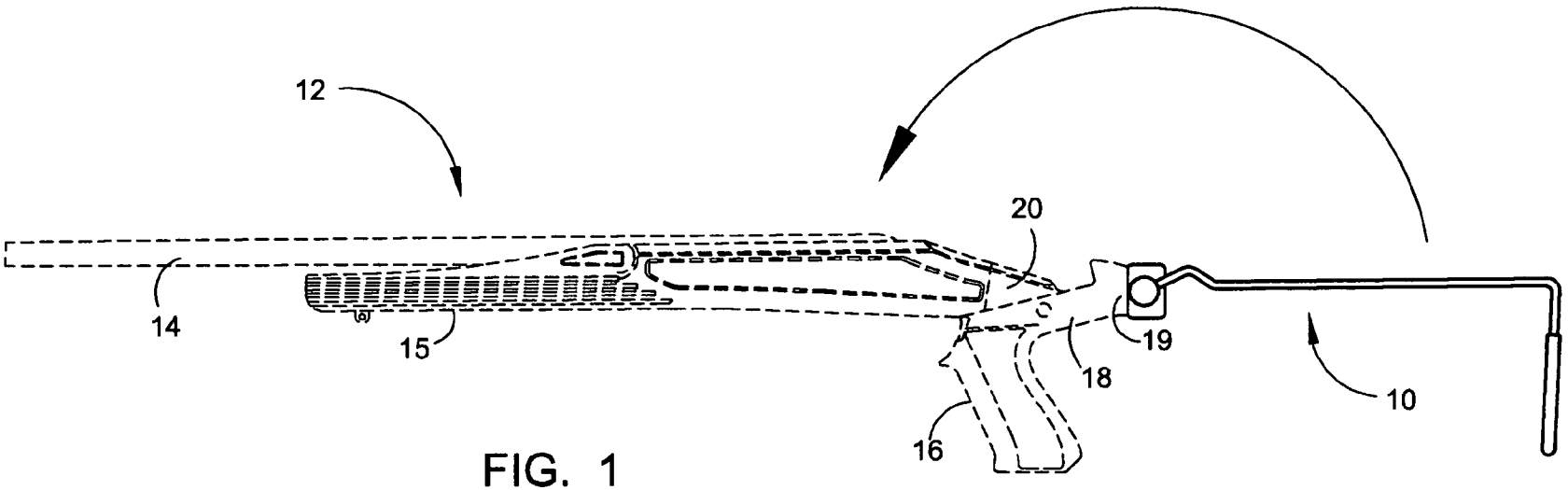
FIG. 1 illustrates a firearm with the elongated stock in its rearward functional deployed position.
Figure 2:
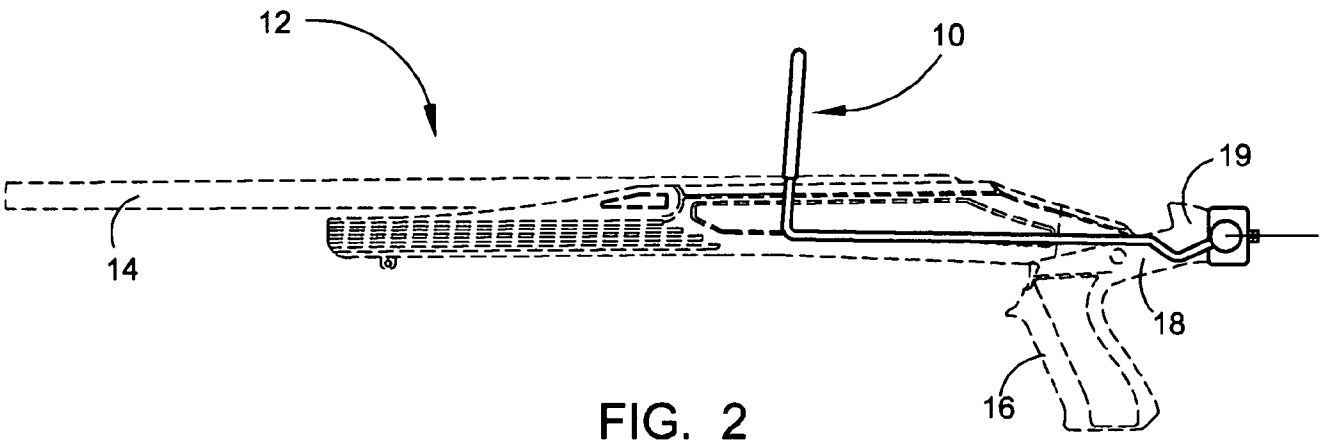
FIG. 2 illustrates the elongated stock pivoted forward to its static forward stored position.
Figure 3:
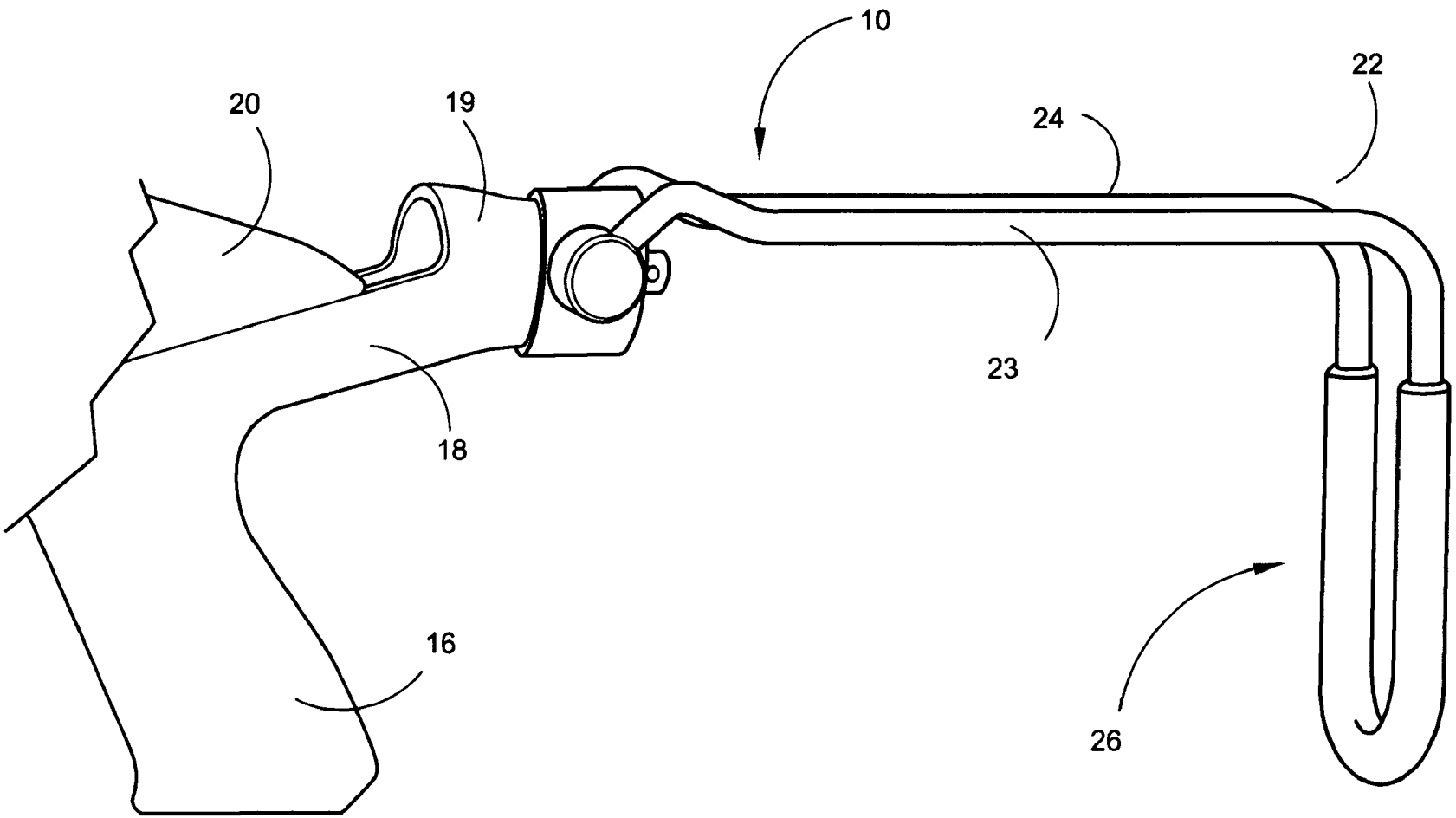
FIG. 3 is a side perspective view illustrating the folding stock assembly secured to the rear end of the neck portion of a handgrip.

The folding stock assembly is shown secured to the rear end of a firearm in FIGS. 1 and 2. The folding stock assembly is generally designated numeral 10. The firearm 12 has a gun barrel 14, a forend 15, and a handgrip 16. A neck portion 18 extends rearwardly from the top end of handgrip 16 and it has a tubular member 19 formed at its rear end. A connecting member 20 secures the receiver of the firearm to the top end of handgrip 16. In FIG. 1 the folding stock assembly 10 is illustrated in its rearward functional deployed position. In FIG. 2 the folding stock assembly 10 is illustrated in its static forward stored position.

Elongated stock 22 has laterally spaced left elongated arm member 23 and right elongated arm member 24. A U-shaped shoulder rest portion 26 has its top end connected to the rear end of the respective right and left elongated arm members 23 and 24.

Figure 4:
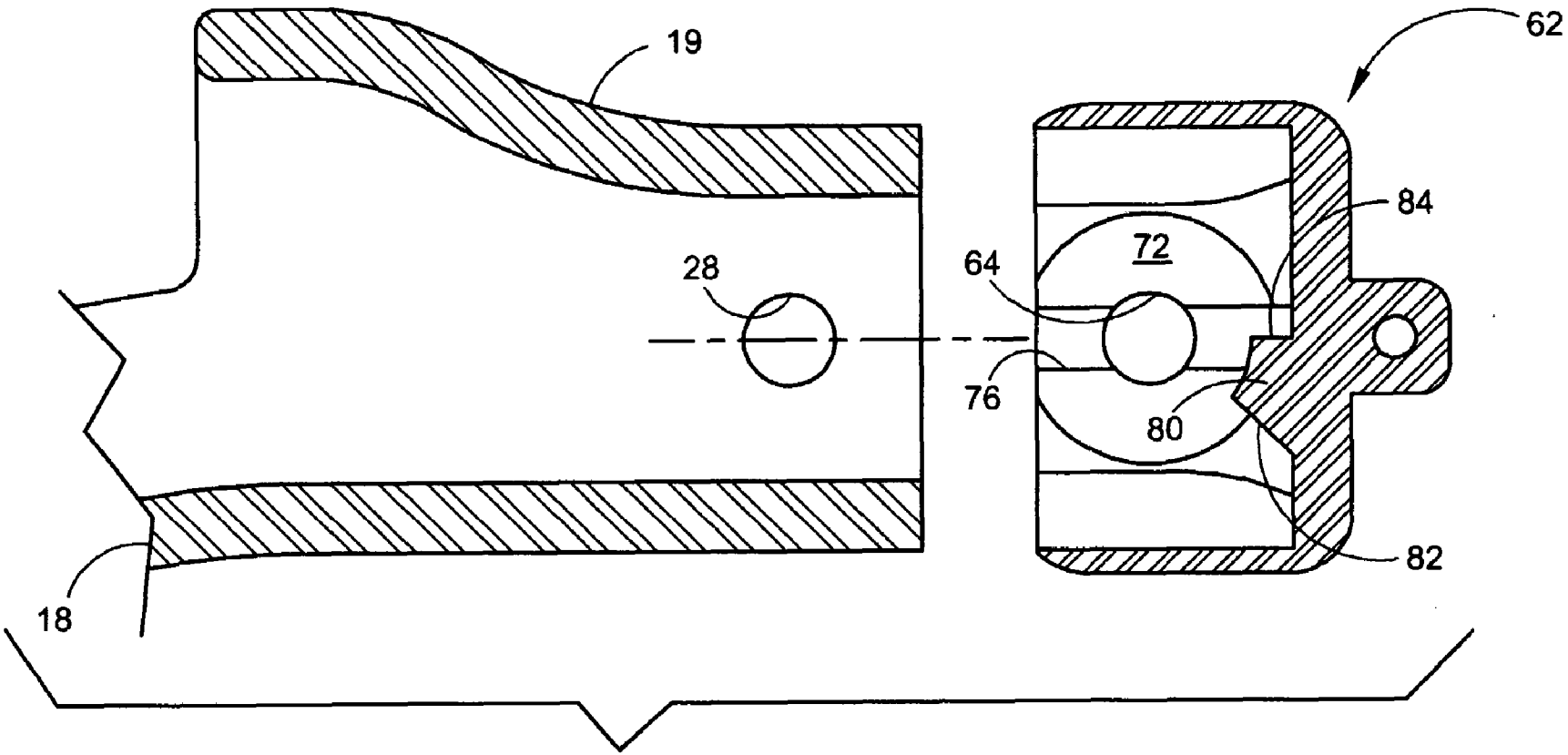
FIG. 4 is an exploded cross sectional view of the neck portion and the end cap illustrated in FIG. 3.
Figure 5:
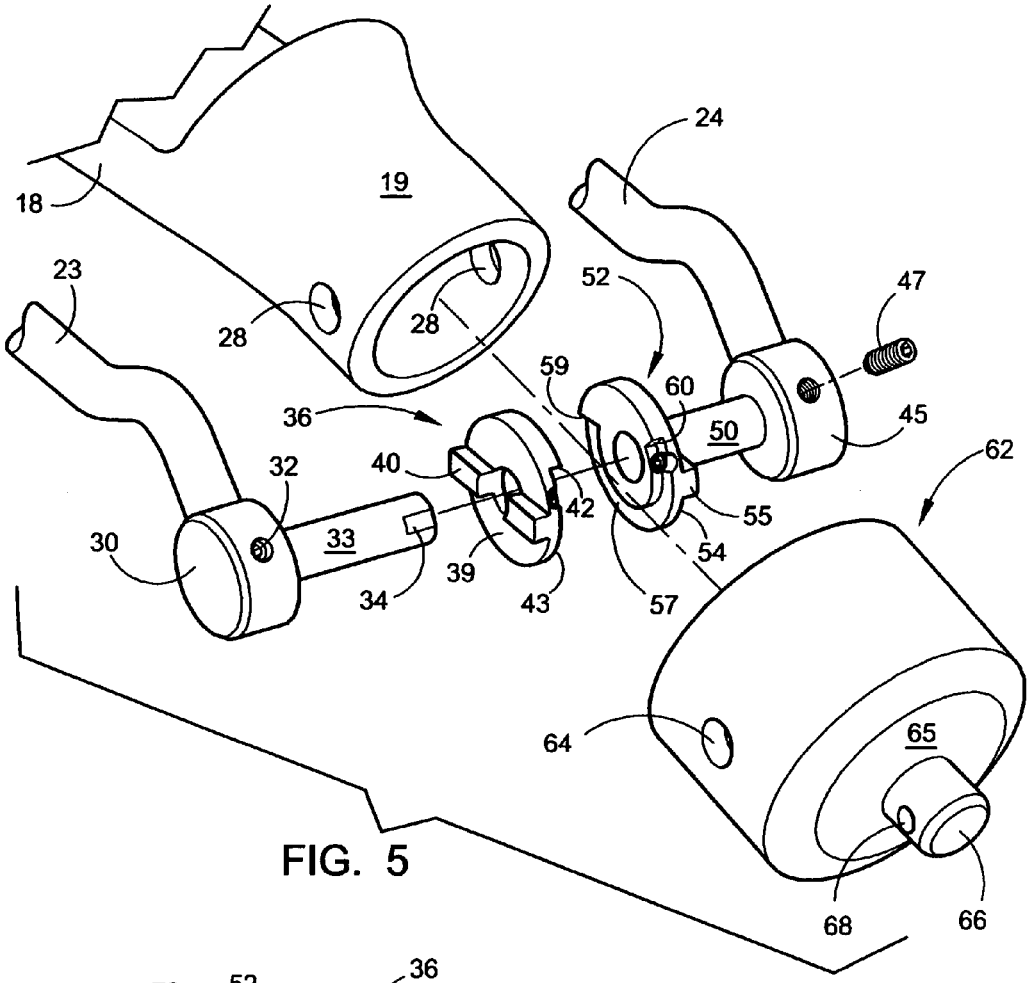
FIG. 5 is an exploded view illustrating the unique structure secured to the front ends of the left and right elongated arm members of the stock.

FIGS. 4 and 5 should be referred to when discussing the manner in which the folding stock assembly is secured to the tubular portion 19 of neck portion 18. Tubular portion 19 has a pair of diametrically opposed secondary apertures 28 formed therein. A left front end member 30 is secured to the front end of left elongated arm member by a set screw that is screwed into threaded bore hole 32. The left shaft member 33 extends inwardly from front end member 30 and it has a relieved surface 44 adjacent its front end. A left disc 36 is inserted on the inner end of left shaft member 33 and held securely thereto by set screw 38. The outer surface 39 of left disc 36 has a raised boss member 40 extending across most of its width. A raised shoulder 42 extends inwardly from the inner surface 43. A front end member 45 is secured to the front end of right elongated arm member 24 by a set screw 47 that threads into threaded bore hole 48. A right shaft member 50 extends inwardly from right front end member 45. Right disc 52 is secured on the inner end of right shaft 50. Right disc 52 has an outer surface 54 having a raised boss member 55 extending across most of its width. Right disc 52 has an inner surface 57 having a raised shoulder 58 thereon. Raised shoulder has a stop 59 and a stop 60 that mates with structure in the interior of end cap 62.

Figure 6:
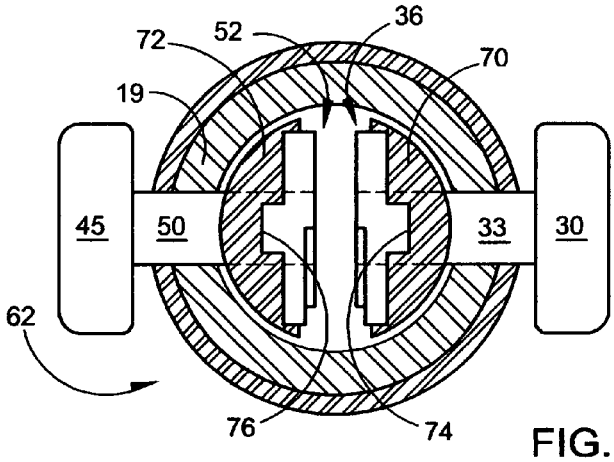
FIG. 6 is a schematic cross section view of the end cap, the tubular member and the structure in the end cap that captures the left and right discs on the left and right shaft members.

The structure that illustrates how left disc 36 and right disc 52 are captured in end cap 62 is best illustrated in FIGS. 4 and 6. End cap 62 has diametrically opposed primary apertures 64, a rear wall 65 and a knob 66 having a sling attachment aperture. The interior of end cap 62 is cylindrical as is the interior of tubular member 19. A left receptacle 70 and a right receptacle 72 each have a cylindrical outer surface that mates with the cylindrical interior of tubular member 19. Left receptacle 70 has a groove 74 that matingly receives raised boss member 40 of left disc 36. Right receptacle 72 has a groove 76 that matingly receives raised boss member 55 of right disc 52. A centrally positioned dog member 80 extends rearwardly from the inner surface of rear wall 65 of end cap 62 in alignment with right disc 52 and left disc 36. Dog member 80 has rotation stops 82 and 84.

When left front end member 30 and right front end member 45 are squeezed together left disc 36 and right disc 52 travel inwardly. This causes raised boss member 40 and raised boss member 55 to disengage from the respective grooves 74 and 76 in receptacles 70 and 72. At this time elongated stock 22 can be pivoted between its static forward stored position and its rearward functional deployed position. The rotation is limited by the stops on the respective shoulders on the inner surface of discs 52 and 36 when they contact the rotation stops 82 and 84 of dog member 80.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended Claims.

What is claimed is:

1. A folding stock assembly for a firearm, comprising;

an elongated stock having laterally spaced left and right elongated arm members each having a front end and a rear end;

said front end of said left elongated arm member having a left front end member secured thereto, said left front end member having a left shaft member extending inwardly therefrom, said left shaft having a front end having a left disc rigidly secured thereto, and said left disc having an outer surface and an inner surface;

said front end of said right elongated arm member having a right front end member secured thereto, said right front end member having a right shaft member extending inwardly therefrom, said right shaft member having a front end having a right disc rigidly secured thereto, and said right disc having an outer surface and an inner surface;

a vertically oriented V-shaped shoulder rest portion having laterally spaced top ends that are connected to the respective rear ends of said respective left and right elongated arm members;

pivot means connected to said respective front ends of said elongated left and right arm members that allow said elongated stock to pivot from a static forward stored position to a functional deployed position;

a handgrip of a firearm having a neck portion extending rearwardly therefrom;

a tubular member having a rear end extending rearwardly from said neck portion, wherein a pair of diametrically opposed secondary horizontal apertures are formed in said tubular member adjacent said rear end; and means for mounting said pivot means to said rear end of said rearwardly extending neck portion of said handgrip.

2. A folding stock assembly as recited in claim 1 wherein said left and right elongated arm members and said V-shaped shoulder rest portion are integrally formed.

3. A folding stock assembly as recited in claim 2 wherein said left and right elongated arm members and said V-shaped shoulder rest portion are made of metal rod.

4. A folding stock assembly as recited in claim 1 in combination with a firearm having a handgrip connected to the rear end of the receiver of the firearm; said handgrip having a neck portion extending rearwardly from the top end of the handgrip; said means for mounting said pivot means is connected to said rear end of said neck portion.

5. A folding stock assembly as recited in claim 1 further comprising a tubular end cap open at its front end and having a rear wall closing said rear end; a pair of diametrically opposed primary horizontal apertures are formed in said cap that align with said diametrically opposed secondary horizontal apertures when said cap is telescoped over said rear end of said tubular member; said left shaft member and said right shaft member are inserted into their respective primary and secondary apertures and this combined structure is the means for mounting said pivot means to the rear end of the neck portion of a handgrip of a firearm.

6. A folding stock assembly as recited in claim 5 wherein said left and right front end members are disc-shaped.

7. A folding stock assembly as recited in claim 5 further comprising a knob extending rearwardly from said rear wall of said cap and there is a sling-attachment aperture extending transversely through said knob.

8. A folding stock assembly as recited in claim 5 further comprising a raised boss member on said outer surface of said left and right disc and they are removably interlocked with structure in said cap to releasably lock said elongated stock in either its static forward stored position or in its rearward functional deployed position.

9. A folding stock assembly as recited in claim 8 wherein said left and right disc have a raised shoulder on their inner surfaces having a pair of stops that limit the number of degrees of rotation of said left and right shaft members.

* * * * *